United States Patent [19]

Bain, Jr.

[11] Patent Number: 4,526,125

[45] Date of Patent: Jul. 2, 1985

[54] SECURITY LOCK FOR KAYAKS AND THE LIKE

[76] Inventor: John W. Bain, Jr., 112 Hedgewood Dr., Chattanooga, Tenn. 37405

[21] Appl. No.: 549,617

[22] Filed: Nov. 7, 1983

[51] Int. Cl.[3] ..... A63C 15/00

[52] U.S. Cl. ..... 114/347; 114/172; 70/18; 441/74

[58] Field of Search ..... 114/347, 343; 24/230.5 R, 129 R; 70/18, 76, 58-62; 224/917; 248/317; 441/74, 75; 114/172

[56] References Cited

U.S. PATENT DOCUMENTS

| | | | |
|---|---|---|---|
| 550,172 | 11/1895 | Hensley | 70/18 |
| 949,809 | 2/1910 | Sheen | 70/62 |
| 2,497,797 | 2/1950 | Rogers | 70/61 |
| 3,830,416 | 8/1974 | Smedley | 224/917 |
| 4,340,376 | 7/1982 | Williams | 441/74 |
| 4,418,550 | 12/1983 | Hamilton | 70/18 |

*Primary Examiner*—Trygve M. Blix
*Assistant Examiner*—C. T. Bartz
*Attorney, Agent, or Firm*—Alan Ruderman

[57] ABSTRACT

A method and apparatus for securing a kayak or similar shaped elongated object. The apparatus includes a pair of hoops each having a diameter large enough to slip over an end of the kayak but not large enough to slip over the entire body thereof. A cable is secured at one end to each of the hoops, the combined length of the cables being shorter than the length of the kayak. A padlock secures the other end of each cable together. A third cable in one embodiment is looped about one of the hoops and a stationary body and has its ends locked together, and in another embodiment one end of the third cable is secured to one of the hoops and locked by the same padlock to the free ends of the first mentioned cables.

14 Claims, 2 Drawing Figures

SECURITY LOCK FOR KAYAKS AND THE LIKE

BACKGROUND OF THE INVENTION

This invention relates to theft prevention and more particularly to a method and apparatus for securing a mobile elongated object, such as a kayak and the like, having a maximum cross-section intermediate opposed ends and tapering to the ends, to a stationary body to preclude and discourage theft of the object.

Although the prior art is replete with theft preventing devices for securely locking various objects against unauthorized removal and theft, no means for securing elongated light weight mobile objects without physically attaching a permanent bracket thereto are disclosed in the prior art. Chains and locks which can be used by passing the chain about a strut or similar portion of the object such as a bicycle are known, which do not require physical attachment of the securing means to the object. However, when the object is of a nature, shape and a material where there is no element about which a chain can be wrapped, and whereby attachment of a bracket would damage the structure and render it non-functional, no theft prevention devices have been developed in the prior art. For example, kayaks and similar decked white water boats are elongated objects having a general shape such that it tapers from a major dimension at the cockpit or passenger opening to a generally pointed end at each opposed end. Although there may be fastening devices for securing other objects having a general configuration of a kayak, because of the nature of the thin flexible covering about the hull physical attachment of a member to a surface or even the frame is precluded not only because of potential leakage problems caused by perforating the hull, but because the device usually could be pulled or ripped out of the covering or skin. Thus, no such securing devices are used for kayaks and theft has become a problem where white water kayaking is popular.

SUMMARY OF THE INVENTION

Consequently, it is a primary object of the present invention to provide a method and apparatus for securing an elongated object having a body tapering toward each end from a maximum dimension without physically and permanently attaching apparatus to the object.

It is another object of the present invention to provide a method and apparatus for securing an object, such as a kayak having a maximum cross-section intermediate opposed ends and tapering to the ends, to a fixed structure for precluding and discouraging theft of the object.

It is a further object of the present invention to provide a method and apparatus for securing a kayak to a stationary body using a pair of hoops, each hoop having a diameter large enough such that each hoop may be slipped onto the body of the kayak from an opposite end and smaller than the dimension of the kayak in the central portion so that the hoops cannot pass over the central portion, and means for securing the hoops together when so positioned and for securing at least one hoop to a stationary body.

Accordingly, the present invention provides a method and apparatus for securing a kayak or similar shaped elongated object having a larger body dimension at the central portion than at the ends, the apparatus comprising a pair of hoops, each hoop having a diameter large enough to slip over an end of the object but not large enough to slip over the entire body thereof, a cable fastened to each hoop and together, the cables and hoops forming a harness shorter than the length of the object, and another cable fastened to the harness and to a stationary body. In the preferred forms of the invention one end of a first cable is secured to each hoop and the other ends of the cables are removably locked together, while a second cable may pass through one of the hoops and have its ends lock together or the second cable may have one end secured to one of the hoops and its other end removably locked together with the locked ends of the first cables, but in either case the second cable encircles a stationary body to secure the hoops and thus the kayak to the stationary body.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENTS

Figure 1:
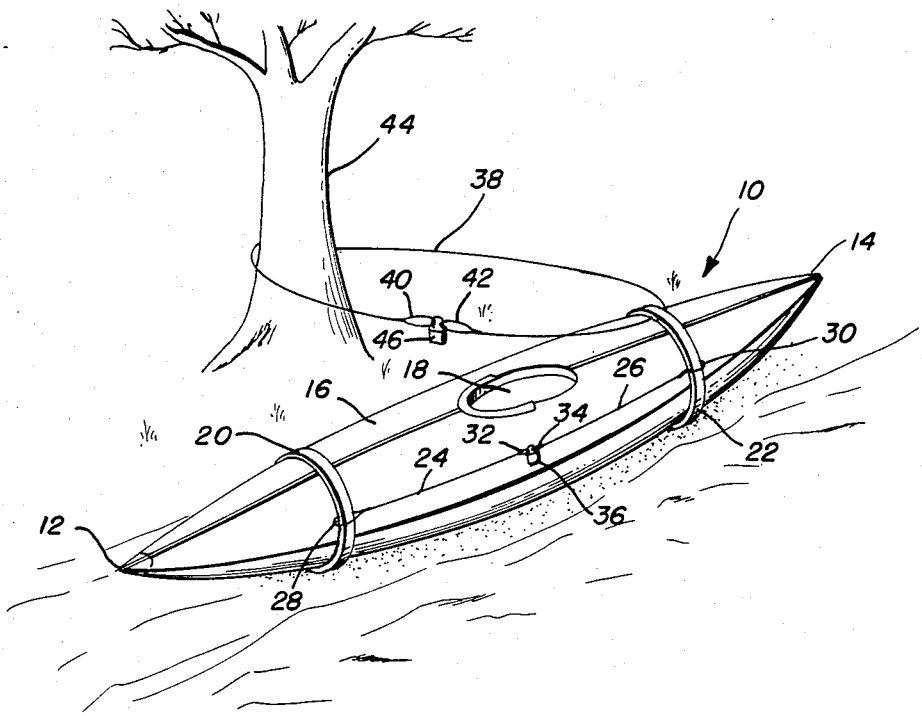
FIG. 1 is a perspective view of a kayak secured to a tree using the method and apparatus constructed in accordance with a first embodiment incorporating the principles of the present invention.

Referring to FIG. 1 of the drawings, a kayak 10 is illustrated as having a hull including a pair of opposed substantially pointed ends 12, 14 which taper more or less gradually from a second portion 16 in which the kayak has an occupant receiving opening 18. Although the invention is illustrated in connection with a kayak, it should be understood that any elongated object having a body configuration of substantially the same shape can be secured to a stationary body using the method and apparatus of the present invention. Thus, the invention may be applicable to bodies having pointed ends, ellipsoids, rounded oblong bodies and the like, as long as the ends are of a smaller cross-sectional dimension than the central portion of the body.

Apparatus constructed in accordance with the invention comprises a pair of annular hoops or rings 20, 22 which for ease of manufacture and availability preferably are circular, the hoops being of a diameter larger than the diameter or largest cross-sectional dimension at the ends 12, 14 so that the hoops can slip over the respective end, but the diameter of the hoops are less than the diameter or largest cross sectional dimension of the kayak at the central portion 16. Thus, each hoop 20, 22 once positioned on the kayak cannot slip over the entire hull. A cable 24, 26 or similar cordage, such as a chain, rope, strap, wire etc. all of which are included within the term cable is fastened at one end as by loops 28, 30 securely formed on the end and extending about the respective hoop 20, 22 and have its other ends formed into respective loops 32, 34 so that a padlock 36 or other locking members may extend through the loops 32, 34 and securely and removably lock the cables 24 and 26 together, the combined length of the cable 24, 26 being less than the length of the kayak. Once this has occurred, the hoops 20, 22 and cables 24, 26 form a harness about the kayak and the hoops 20, 22 cannot be slipped back over the respective ends of the kayak until the padlock is opened. Of course, a single cable may be looped through both hoops 32, 34 and padlocked together at loops on the ends, but substantially twice the amount of cable would then be necessary and thus more costly. Another cable 38 having loops 40, 42 on its ends may be looped through at least one of the hoops such as hoop 22 and looped about a stationary body such as tree 44, as illustrated in FIG. 1, or other stationary body such as a car bumper, dock post, etc. Another padlock 46 or the like may then connect and lock the loops 40, 42 together to secure the kayak to the stationary body. Similarly the cable 38 may be looped about the locked cables 24, 26 rather than about one of the hoops.

Figure 2:
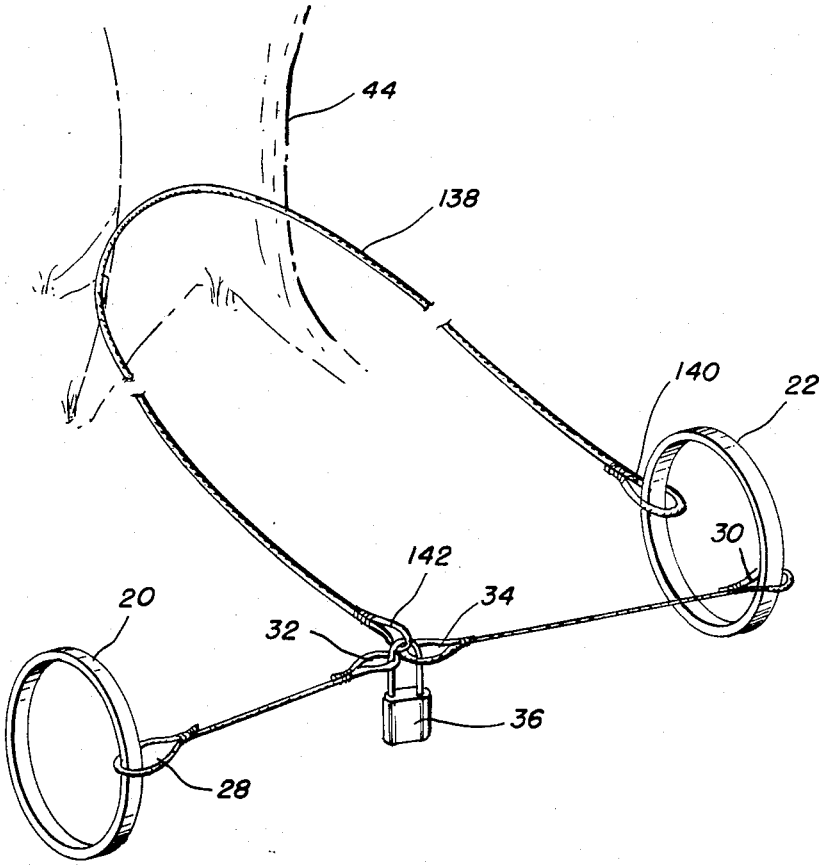
FIG. 2 is a perspective view similar to FIG. 1 but with the kayak removed and illustrating apparatus constructed in accordance with a second embodiment of the invention.

In FIG. 2 only the single padlock 36 is necessary to secure the kayak or the like to the tree. This is accomplished by looping one end of a cable 138 about one of the hoops, such as hoop 22, and securing it to the adjacent portion of the cable to form a loop 140, while the other end of the cable has a loop 142 which can be secured to the loops 32, 34 of the cables 20, 22 by the single padlock 36. Again it should be understood that the loop 140 rather than encircling hoop 22 may be free so that the cable 138 can be looped about the tree and both loops 140 and 142 may thereafter be secured to the loops 32, 34 by the single padlock.

Thus, a very simple inexpensive method and apparatus is disclosed for securing mobile objects of the aforesaid shape to a stationary body, and especially such an object which should not be perforated or otherwise physically penetrated.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of securing a kayak to a stationary body, comprising inserting one end of said kayak through a first hoop and inserting the other end of said kayak through a second hoop, each hoop having a cross-sectional dimension larger than the respective end of said kayak and smaller than the cross-sectional dimension of the occupant receiving portion of said kayak, selectively tying said hoops together such that neither hoop can be dislodged from the end of said kayak inserted therein, and securing at least one of said hoops to said stationary object.

2. In the method as recited in claim 1, wherein said hoops are tied together by first cable of a length shorter than the length of said kayak.

3. In the method as recited in claim 2. wherein said step of securing at least one of said hoops comprises looping a second cable about said stationary body and said hoop, and locking the ends of said second cable together.

4. In the method as recited in claim 2, wherein said step of securing at least one of said hoops comprises looping a second cable about said stationary body and said hoop, fastening one end of said second cable to said hoop and fastening the other end to said first cable.

5. In the method as recited in claim 1, wherein said step of tying said hoops together comprises fastening one end of a first cable to one of said hoops, fastening one end of a second cable to the other of said hoops, and removably fastening the other ends of said first and second cables together.

6. In the method as recited in claim 5, wherein said step of securing at least one of said hoops comprises looping a third cable about said kayak and said hoop, and locking the ends of said third cable together.

7. In the method as recited in claim 5, wherein said step of securing at least one of said hoops comprises looping a third cable about said stationary body and said hoop, fastening one end of said third cable to said hoop, and removably fastening the other end of said third cable to said other ends of said first and second cables.

8. Security apparatus for securing an elongated mobile object to a stationary body, said object having a central portion narrowing toward opposed spaced apart ends, said apparatus comprising a pair of hoops each haivng a diameter larger than the maximum cross-sectional dimension of a respective end of the object and smaller than the maximum cross-sectional dimension of the central portion, a first cable having one end fastened to one of said hoops, a second cable having one end fastened to the other of said hoops, the combined length of said first and second cables being less than the length of said object, locking means for selectively connecting and disconnecting the other ends of said first and second cables together to form a harness about said object, a third cable, and means for selectively connecting and disconnecting said third cable to said harness and to said stationary body.

9. Security apparatus as recited in claim 8, wherein said one end of each of said first or second cables is securely looped about a respective hoop, and said locking means includes a loop formed on one end of said first and second cables, and releasable means extending through both loops on said other ends for fastening said loops together.

10. Security apparatus as recited in claim 8, wherein said third cable encircles said stationary body and a portion of said harness, and said means for selectively connecting and disconnecting said third cable comprises a loop formed on each end of said third cable, and means extending through both loops of said third cable for fastening said third cable loops together.

11. Security apparatus as recited in claim 9, wherein said third cable encircles said stationary body, one end of said third cable being securely looped about one of said hoops, and the other end of said third cable having a loop formed thereon, and said releasable means extends through said other end of said first, second and third cables.

12. Security apparatus as recited in claim 8, wherein said object is a kayak and said hoops are circular rings.

13. A method of securing an elongated mobile object to a stationary body, said object having a central portion narrowing toward spaced apart ends, said method comprising: inserting one end of said object through a first hoop and inserting the other end of said object through a second hoop, each hoop having a cross-sectional dimension larger than than that of the respective ends and smaller than the largest cross-sectional dimension of said central portion, selectively tying said hoops together by a first cable of a length shorter than the length of said object such that when tied neither hoop can be dislodged from the end inserted therein, and securing at least one of said hoops to said stationary object by looping a second cable about said stationary body and said hoop, and locking the ends of said second cable together.

14. A method of securing an elongated mobile object to a stationary body, said object having a central portion narrowing toward spaced aparts ends, said method comprising: inserting one end of said object through a first hoop and inserting the other end of said object through a second hoop, each hoop having a cross-sectional dimension larger than that of the respective ends and smaller than the largest cross-sectional dimension of said central portion, selectively tying said hoops together by a first cable of a length shorter than the length of said object such that when tied neither hoop can be dislodged from the end inserted therein, and securing at least one of said hoops to said stationary object by looping a second cable about said stationary body and said hoop, fastening one end of said second cable to said hoop and fastening the other end to said first cable.

* * * * *